US011020983B2

(12) United States Patent
Murai

(10) Patent No.: US 11,020,983 B2
(45) Date of Patent: Jun. 1, 2021

(54) LIQUID EJECTING DEVICE AND LIQUID EJECTING METHOD

(71) Applicant: SEIKO EPSON CORPORATION, Tokyo (JP)

(72) Inventor: Masayuki Murai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/740,938

(22) Filed: Jan. 13, 2020

(65) Prior Publication Data

US 2020/0223229 A1 Jul. 16, 2020

(30) Foreign Application Priority Data

Jan. 16, 2019 (JP) ..... JP2019-004983

(51) Int. Cl.

| | |
|---|---|
| ***B41J 2/21*** | (2006.01) |
| ***B41J 2/07*** | (2006.01) |
| ***B41J 11/00*** | (2006.01) |

(52) U.S. Cl.

CPC . *B41J 2/21* (2013.01); *B41J 2/07* (2013.01); *B41J 11/002* (2013.01)

(58) Field of Classification Search

CPC ..... B41J 2/21; B41J 2/07; B41J 11/002
See application file for complete search history.

(56) References Cited

U.S. PATENT DOCUMENTS

2018/0281492 A1* 10/2018 Matsuzaki ..... B41J 11/002

FOREIGN PATENT DOCUMENTS

| | | |
|---|---|---|
| EP | 3357699 | 8/2018 |
| EP | 33567699 | 8/2018 |
| JP | 2000343807 | 12/2000 |
| JP | 2018122557 | 8/2018 |

* cited by examiner

*Primary Examiner* — Bradley W Thies
(74) *Attorney, Agent, or Firm* — Workman Nydegger

(57) ABSTRACT

Provided is a liquid ejecting device that includes an ejecting unit configured to eject liquid and a control unit that performs control to apply the liquid to a medium. The ejecting unit is configured to eject, as the liquid, ink, that contains a color material, and inhibitor for inhibiting penetration of the color material into the medium. The control unit is configured to select a first printing mode in which applying the ink to the medium without applying the inhibitor to the medium, and a second printing mode in which applying the inhibitor to the medium and applying the ink to the medium applied with the inhibitor. The control unit causes an amount of the ink applied per unit area in the second printing mode to be smaller than an amount of the ink applied per unit area in the first printing mode.

7 Claims, 6 Drawing Sheets

LIQUID EJECTING DEVICE AND LIQUID EJECTING METHOD

The present application is based on, and claims priority from JP Application Serial Number 2019-004983, filed Jan. 16, 2019, the disclosure of which is hereby incorporated by reference herein in its entirety.

BACKGROUND

1. Technical Field

The present disclosure relates to a liquid ejecting device and a liquid ejecting method.

2. Related Art

In related art, various liquid ejecting devices have been used. In such liquid ejecting devices, various types of media and inks of various compositions are used. Thus, depending on the type or the like of the medium or ink used, a phenomenon known as strike-through of the ink may occur in which a color material of the ink ejected onto the medium penetrates to the reverse side of the medium, and the color of the ink appears on the reverse side. Here, a liquid ejecting method and the like intended to suppress the strike-through of the ink is disclosed. For example, in JP-A-2000-343807, an ink recording method is disclosed that applies ink to a recording medium after a penetration enhancer was applied to the recording medium.

However, in recent years, medium and ink have become increasingly diverse, and even when the ink recording method disclosed in JP-A-2000-343807 is performed, there may be strike-through of the ink due to the type and the like of the medium and ink used.

SUMMARY

A liquid ejecting device according to the present disclosure for solving the above-described problem includes an ejecting unit configured to eject liquid, and a control unit configured to perform control to cause the ejecting unit to eject the liquid to apply the liquid to a medium. The ejecting unit is configured to eject, as the liquid, ink, that contains a color material, for forming an image on the medium, and inhibitor for inhibiting penetration of the color material into the medium. The control unit is configured to select a first printing mode for forming an image on the medium by applying the ink to the medium without applying the inhibitor to the medium, and a second printing mode for forming an image on the medium by applying the inhibitor to the medium and applying the ink to the medium applied with the inhibitor, and the control unit causes an amount of the ink applied per unit area in the second printing mode to be smaller than an amount of the ink applied per unit area in the first printing mode.

DESCRIPTION OF EXEMPLARY EMBODIMENTS

Figure 1:
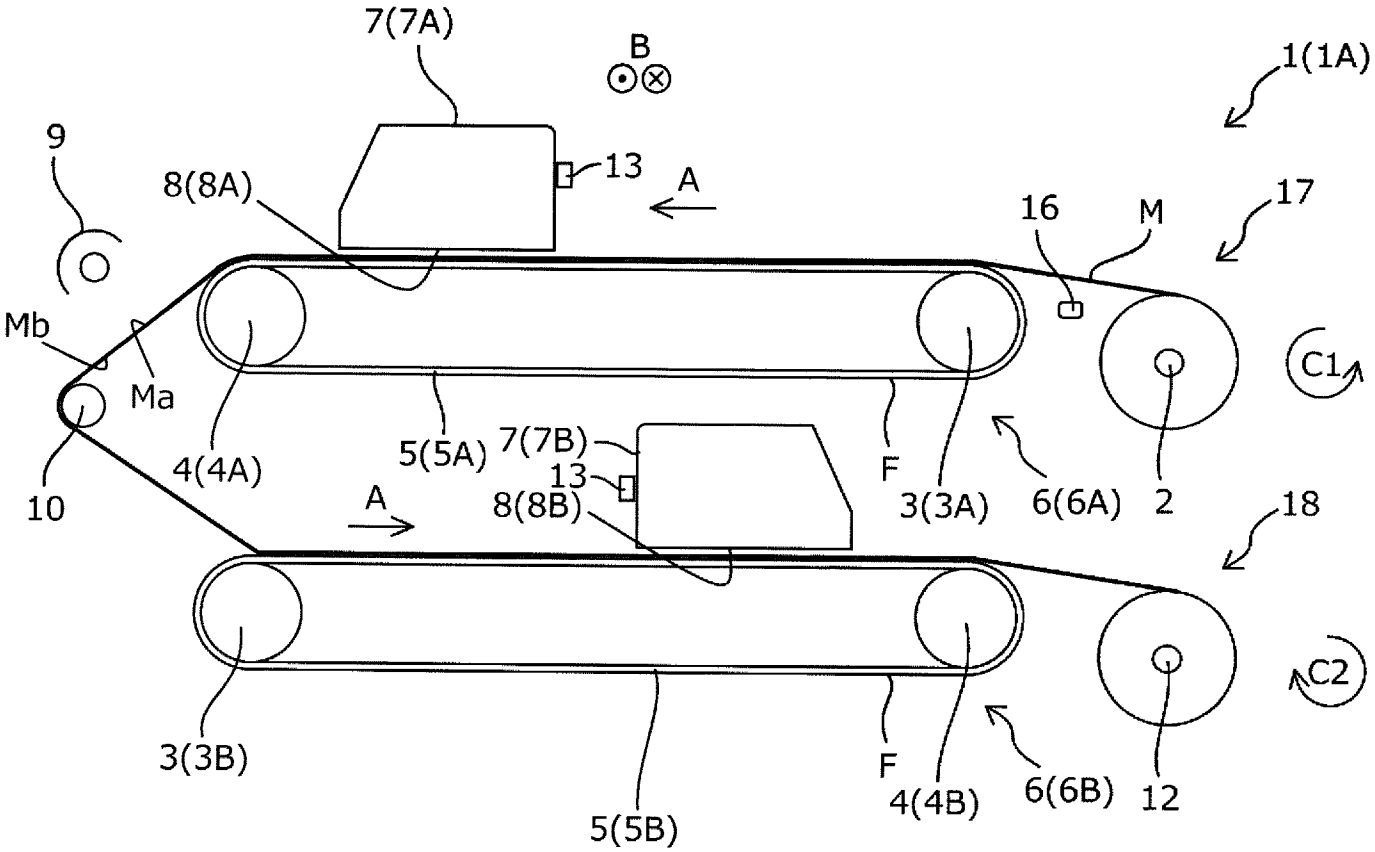
FIG. 1 is a schematic side view of a liquid ejecting device according to Example 1 of the present disclosure.

First, an overview of the present disclosure will be described.

A liquid ejecting device according to a first aspect of the present disclosure for solving the above-described problem includes an ejecting unit capable of ejecting liquid, and a control unit configured to perform control to cause the ejecting unit to eject the liquid to apply the liquid to a medium. The ejecting unit is configured to be capable of ejecting, as the liquid, ink that contains a color material and is for forming an image on the medium, and inhibitor for inhibiting penetration of the color material into the medium. The control unit is configured to select a first printing mode for forming an image on the medium by applying the ink to the medium without applying the inhibitor to the medium, and a second printing mode for forming an image on the medium by applying the inhibitor to the medium and applying the ink to the medium applied with the inhibitor, and the control unit causes an amount of the ink applied per unit area in the second printing mode to be smaller than an amount of the ink applied per unit area in the first printing mode.

According to the present aspect, the amount of the ink applied per unit area in the second printing mode, in which the image is formed on the medium by applying the ink to the medium applied with the inhibitor, is caused to be smaller than the amount of the ink applied per unit area in the first printing mode, in which the image is formed on the medium by applying the ink to the medium without applying the inhibitor. Specifically, the amount of ink applied per unit area in the second printing mode can be reduced, and by reducing the amount of ink applied, strike-through of the ink can be suppressed even when a medium or ink that is susceptible to the strike-through is used.

The liquid ejecting device according to a second aspect of the present disclosure is the liquid ejecting device of the first aspect, in which the control unit is configured to select, as the second printing mode, a single-sided printing mode for forming an image on the first surface by applying the inhibitor to a first surface of the medium and applying the ink to the first surface applied with the inhibitor, and ending the printing, and a double-sided printing mode for forming an image on the first surface by applying the inhibitor to the first surface and applying the ink to the first surface applied with the inhibitor, and subsequently forming an image on a second surface by applying the inhibitor to the second surface on an opposite side of the medium from the first surface and applying the ink to the second surface applied with the inhibitor.

According to the present aspect, since the single-sided printing mode and the double-sided printing mode can be selectively performed, through the single-sided printing mode, it is possible, while making the most of a basic condition of one surface of the medium, to form the image on the other surface, and through the double-sided printing mode, it is possible to suppress the strike-through of the ink and form images on both surfaces of the medium.

The liquid ejecting device according to a third aspect of the present disclosure is the liquid ejecting device of the second aspect, in which the ejecting unit includes a first ejecting unit capable of ejecting the liquid onto the first surface, and a second ejecting unit capable of ejecting the liquid onto the second surface. The control unit, in the double-sided printing mode, performs control to cause the first ejecting unit to eject the liquid to form an image on the first surface, and to subsequently cause the second ejecting unit to eject the liquid to form an image on the second surface.

According to the present aspect, the images can be formed on both surfaces of the medium using the first ejecting unit and the second ejecting unit, while favorably suppressing the strike-through of the ink.

The liquid ejecting device according to a fourth aspect of the present disclosure is the liquid ejecting device of the second aspect, further including an inversion mechanism for the medium. The control unit, in the double-sided printing mode, performs control to cause the ejecting unit to eject the liquid to form an image on the first surface, and to subsequently control the inversion mechanism to invert the medium, and cause the ejecting unit to eject the liquid to form an image on the second surface.

According to the present aspect, the images can be formed on both surfaces of the medium using the liquid ejecting device having a simple configuration provided with the single ejecting unit, while suppressing the strike-through of the ink.

The liquid ejecting device according to a fifth aspect of the present disclosure is the liquid ejecting device of any one of the first to fourth aspects, further including an imaging unit configured to capture an image of a back surface, that is a surface on an opposite side of the medium from a top surface, when the top surface is a surface of the medium facing the ejecting unit, and a warning unit configured to perform a warning operation by control of the control unit. The control unit determines, based on data of the image captured by the imaging unit, whether an image is formed on the back surface, and causes the warning unit to perform the warning operation in a case where it is determined that the image is formed on the back surface when the first printing mode is selected.

According to the present aspect, when forming the image on the top surface of the medium on which the image is formed on the back surface, it is possible to reduce a possibility of deterioration of the quality of the image formed on the back surface by the strike-through of the ink ejected onto the top surface as a result of mistakenly selecting the first printing mode.

The liquid ejecting device according to a sixth aspect of the present disclosure is the liquid ejecting device according to any one of the first to fifth aspects, further including a support surface configured to support the medium at a position facing the ejecting unit, and a gap changing unit configured to change a gap between the ejecting unit and the support surface. The control unit changes, based on the gap, an amount of the inhibitor applied per unit area in the second printing mode.

The thin medium is susceptible to the strike-through, and the thick medium is not so susceptible to the strike-through, but according to the present aspect, the amount of inhibitor applied per unit area in the second printing mode is changed based on the gap that corresponds to the thickness of the medium, and thus, the strike-through of the ink can be suppressed in accordance with the thickness of the medium.

The liquid ejecting device according to a seventh aspect of the present disclosure is the liquid ejecting device of any one of the first to sixth aspects, in which the inhibitor contains at least one of metal ions or saccharides.

Since the metal ions and the saccharides can favorably thicken the ink or coagulate the color material, according to the present aspect, the penetration of the color material into the medium can be favorably suppressed and the strike-through of the ink in the medium can be favorably suppressed.

A liquid ejecting method of an eighth aspect of the present disclosure is a liquid ejecting method for a liquid ejecting device including an ejecting unit configured to eject liquid and configured to eject, as the liquid, ink that contains a color material and is for forming an image on the medium, and inhibitor for inhibiting penetration of the color material into the medium. The liquid ejecting method includes causing an amount of the ink applied per unit area in a second printing mode to be smaller than an amount of the ink applied per unit area in a first printing mode, when the first printing mode for forming an image on the medium by applying the ink to the medium without applying the inhibitor to the medium, and the second printing mode for forming an image on the medium by applying the inhibitor to the medium and applying the ink to the medium applied with the inhibitor are selectable.

According to the present aspect, the amount of ink applied per unit area in the second printing mode, in which the image is formed on the medium by applying the ink to the medium applied with the inhibitor, is caused to be smaller than the amount of ink applied per unit area in the first printing mode, in which the image is formed on the medium by applying the ink to the medium without applying the inhibitor. Specifically, the amount of ink applied per unit area in the second printing mode can be reduced, and by reducing the amount of ink applied, the strike-through of the ink in the medium can be suppressed even when the medium or ink that is susceptible to strike-through is used, for example.

Embodiments of the present disclosure will be described below with reference to the accompanying drawings.

Example 1 (FIG. 1 to FIG. 5)

First, an outline of a liquid ejecting device 1 according to Example 1 of the present disclosure will be described with reference to FIG. 1.

As illustrated in FIG. 1, a liquid ejecting device 1A of the present example is provided with a first printing unit 17 capable of forming an image on a first surface Ma of a medium M, and a second printing unit 18 capable of forming an image on a second surface Mb on an opposite side of the medium M from the first surface Ma. The first printing unit 17 and the second printing unit 18 are both provided with a carriage 7 that includes a head 8 as an ejecting unit capable of ejecting liquid, and a transport device 6 that includes a driven roller 3, a driving roller 4, and a transporting belt 5 and is capable of transporting the medium M in a transport direction A. After the image is formed on the first surface Ma by the first printing unit 17, the first surface Ma and the second surface Mb of the medium M are inverted by an inversion roller 10, the medium M is transported to the second printing unit 18, and the image is formed on the second surface Mb by the second printing unit 18.

The first printing unit 17 is provided with a setting unit 2 that sets the roll-type medium M. Further, the first printing unit 17 is provided with a transport device 6A capable of transporting the medium M, which has been fed out from the setting unit 2, in a transport direction A, by rotating the roll-type medium M in a rotation direction C1. The transport device 6A is provided with a driven roller 3A positioned upstream in the transport direction A, a driving roller 4A positioned downstream in the transport direction A, and a transporting belt 5A that is an endless belt stretched across the driven roller 3A and the driving roller 4A. The medium M is supported on a support surface F, which is an outer surface of the transporting belt 5A, and is transported. Note that an imaging unit 16, which captures an image of the second surface Mb of the medium M, is provided between the setting unit 2 and the transport device 6A.

Here, the transporting belt 5A is an adhesive belt coated with an adhesive on the support surface F. As illustrated in FIG. 1, the medium M is supported and transported by the transporting belt 5A in a state in which the medium M is adhered to the support surface F coated with the adhesive. In other words, the transporting belt 5A is a support portion for the medium M. A support region over which the transporting belt 5A supports the medium M is an upper-side region of the transporting belt 5A that is stretched across the driven roller 3A and the driving roller 4A. Further, the driving roller 4A is a roller that rotates as a result of a driving force of a transport motor 28 to be described later with reference to FIG. 4, and the driven roller 3A is a roller that rotates as a result of being driven by the rotation of the transporting belt 5A in accordance with the driving roller 4A being rotated.

In addition, the first printing unit 17 is provided with a carriage 7A and a head 8A attached to the carriage 7A. The head 8A, which is an ejecting unit capable of ejecting liquid, functions as a printing unit capable of forming the image on the medium M transported in the transport direction A. The head 8A is provided at a position facing the support region of the medium M on the transporting belt 5, and can eject ink that contains a color material and forms the image on the medium M, and inhibitor that inhibits penetration of the color material into the medium M. The inhibitor is liquid capable of suppressing strike-through of the ink in the medium M by inhibiting the penetration of the color material in the ink into the medium M. The liquid ejecting device 1A according to the present example is capable of printing the image by ejecting the ink from the head 8A onto the transported medium M while reciprocating the carriage 7A in a width direction B of the transporting belt 5 that intersects the transport direction A. As a result of being provided with the carriage 7A configured in this manner, the liquid ejecting device 1A according to the present example can form a desired image on the medium M by repeating the transport of the medium M in the transport direction A by a predetermined transport amount, and the ejection of the ink while moving the carriage 7A in the width direction B in a state in which the medium M is stopped. Further, the carriage 7A is provided with a gap changing unit 13 capable of adjusting a gap between the head 8A and the support surface F at a position at which the head 8A and the support surface F face each other.

Note that the liquid ejecting device 1A according to the present example is a so-called serial printer that performs the printing by alternately repeating the transport of the medium M by the predetermined transport amount and the reciprocating movement of the carriage 7. However, the liquid ejecting device 1 may be a so-called line printer, which uses a line head in which nozzles are formed in a line shape in the width direction B of the medium M, and which continuously performs printing while continuously transporting the medium M.

After the image is formed on the medium M by the ink being ejected from the head 8A, the ink is dried by a drying unit 9, and the medium M is sent to the second printing unit 18 via the inversion roller 10. Here, the drying unit 9 of the present example is an infrared heater, but the configuration of the drying unit 9 is not particularly limited. In addition to the configuration in which electromagnetic waves are irradiated, as in the drying unit 9 of the present example, configurations in which heating is performed by an electrically heated wire, or by an air blowing fan, and the like are favorably used.

The second printing unit 18 is provided with a transport device 6B. The transport device 6B is provided with a driven roller 3B having the same configuration as that of the driven roller 3A, a driving roller 4B having the same configuration as that of the driving roller 4A, and a transporting belt 5B having the same configuration as that of the transporting belt 5A. In other words, the transport device 6B has the same configuration as that of the transport device 6A. Therefore, a detailed description of the transport device 6B is omitted. Further, the second printing unit 18 is provided with a carriage 7B. The carriage 7B is provided with a head 8B having the same configuration as that of the head 8A. Further, the carriage 7B is provided with the gap changing unit 13, and the carriage 7B has the same configuration as that of the carriage 7A. Therefore, a detailed description of the carriage 7B is omitted.

Then, the second printing unit 18 is provided with a winding unit 12 that takes up the medium M, on which the images have been formed by ejecting the ink from the head 8A and the head 8B, into a roll shape, by rotating the medium M in a rotation direction C2. Note that it goes without saying that the liquid ejecting device 1 may be provided with other structural members not mentioned above, such as a cleaning mechanism of the transporting belt 5, a maintenance mechanism of the head 8, and the like.

Here, a material for textile printing can be preferably used as the medium M. The term "material for textile printing" refers to a fabric, a garment, other clothing products and the like that are subject to printing. Fabrics include woven cloths, knit fabrics, non-woven cloths, and the like made of natural fibers such as cotton, silk, wool, and the like, chemical fibers such as nylon and the like, or composite fibers of natural fibers and chemical fibers. Further, the garments and other clothing products include sewn products, such as T-shirts, handkerchiefs, scarfs, towels, handbags, and fabric bags, furniture-related products such as curtains, sheets, and bed covers, as well as fabrics and the like before and after cutting that serve as pieces of cloth before sewing.

Note also that the medium M that can be used is not limited to the above-described material for textile printing. In addition to the material for textile printing described above, dedicated inkjet recording paper, such as plain paper, high quality paper, glossy paper, and the like, can be used. Further, for example, a plastic film whose surface has not been processed for inkjet printing, that is, on which an inkjet absorption layer is not formed, as well as a material in which plastic is coated on a substrate of paper or the like, and a material to which a plastic film has been adhered can also be used as the medium M. Such plastic materials include, but are not limited to, for example, polyvinyl chloride, polyethylene terephthalate, polycarbonate, polystyrene, polyurethane, polyethylene, and polypropylene.

Figure 2:
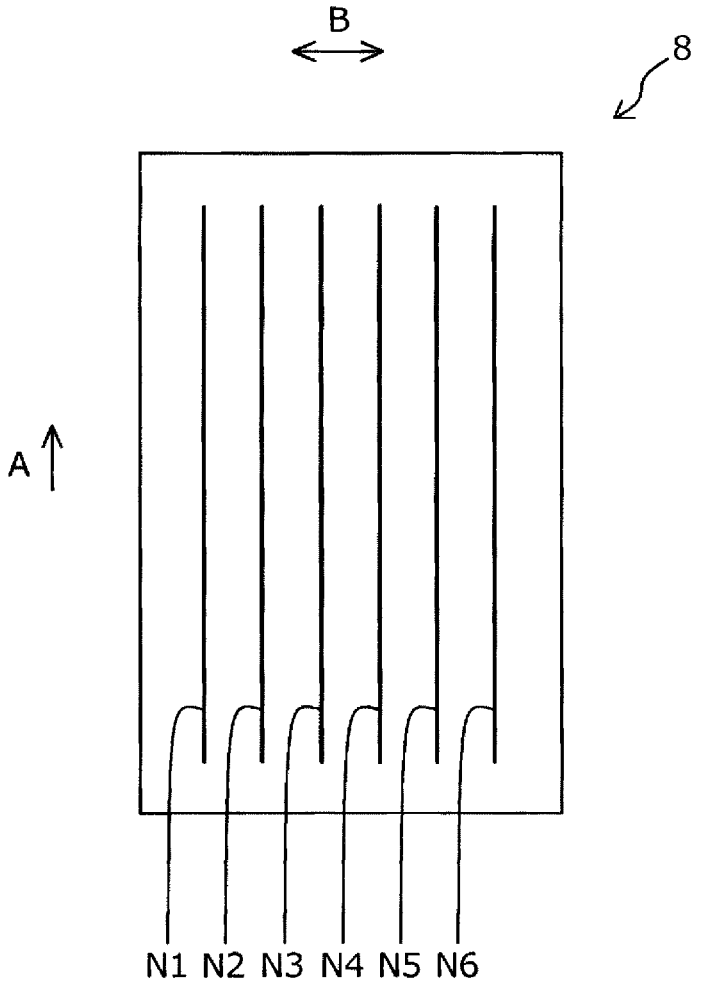
FIG. 2 is a schematic bottom view of a head capable of being used in the liquid ejecting device according to Example 1 of the present disclosure.

Next, an example of the head 8 capable of being used in the liquid ejecting device 1A of the present example will be described. FIG. 2 is an example of the head 8 capable of being used in the liquid ejecting device 1A of the present example. The head 8 illustrated in FIG. 2 has a plurality of nozzle rows N1 to N6 in which nozzles that eject the liquid are arranged along the transport direction A. Specifically, the head 8 has the nozzle rows N2 to N5 that eject the ink that forms the image on the medium M, and the nozzle rows N1 and N6 that eject the inhibitor that inhibits the color material in the ink from penetrating to a surface on the opposite side, of the medium M, from the surface onto which the ink is ejected. By adopting the configuration in which the nozzle rows N2 to N5 are sandwiched by the nozzle rows N1 and N6, the inhibitor can be ejected onto the medium M in advance of the ink in both the movement in the forward direction and the movement in the return direction, in the reciprocating movement of the carriage 7 in the width direction B.

Figure 3:
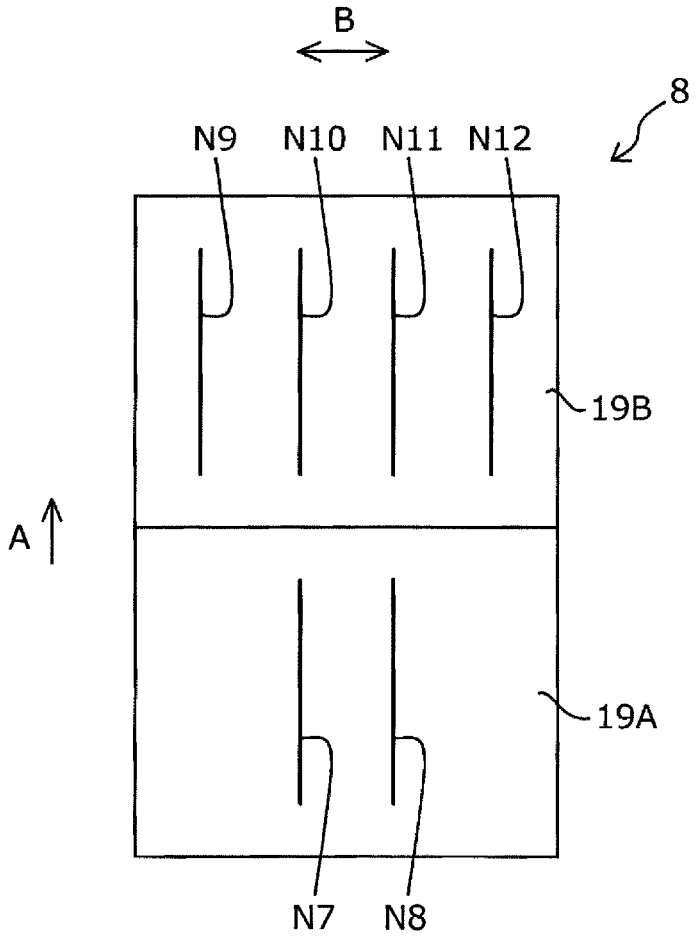
FIG. 3 is a schematic bottom view of another type of the head capable of being used in the liquid ejecting device according to Example 1 of the present disclosure.

Further, FIG. 3 is an example of the head 8 capable of being used in the liquid ejecting device 1A of the present example, and is a separate example from that of the head 8 illustrated in FIG. 2. In the head 8 illustrated in FIG. 3, nozzle rows N7 and N8 that eject the inhibitor are formed upstream in the transport direction A, and nozzle rows N9 to N12 that eject the ink are formed downstream in the transport direction A. Such a configuration allows the inhibitor to be ejected onto the medium M in advance of the ink. Note that, in the head 8 illustrated in FIG. 3, a configuration is adopted in which an inhibitor ejecting unit 19A formed by the nozzle rows N7 and N8 that eject the inhibitor, and an ink ejecting unit 19B formed by the nozzle rows N9 to N12 that eject the ink are provided on the same carriage 7, but a configuration may be adopted in which the inhibitor ejecting unit 19A and the ink ejecting unit 19B are provided on the separate carriages 7. In other words, any configuration may be adopted as long as the inhibitor ejecting unit 19A is provided upstream of the ink ejecting unit 19B in the transport direction A.

Here, for the ink, as long as the color material used to form the image on the medium M and a solvent of the color material are included therein, the ink can be used without particular limitations on the composition, physical properties, and the like thereof. However, when a pigment is used as the color material, the effect of inhibiting the strike-through of the ink by the inhibitor is higher than in a case where a dye is used as the color material.

It is also preferable that the inhibitor contain at least one of metal ions or saccharides. This is because, since the metal ions and the saccharides can favorably thicken the ink or coagulate the color material, and therefore, the penetration of the color material into the medium M can be favorably suppressed and the strike-through of the ink in the medium M can be favorably suppressed. Note that a multivalent metal can more favorably suppress the strike-through of the ink than a monovalent metal. Furthermore, by using chloride ions as the counterions of the metal, it is possible to suppress the influence of discoloration or the like of the medium M to a greater extent than when using nitrate ions or the like, for example.

Next, the electrical configuration of the liquid ejecting device 1A of the present example will be described with reference to FIG. 4.

Figure 4:
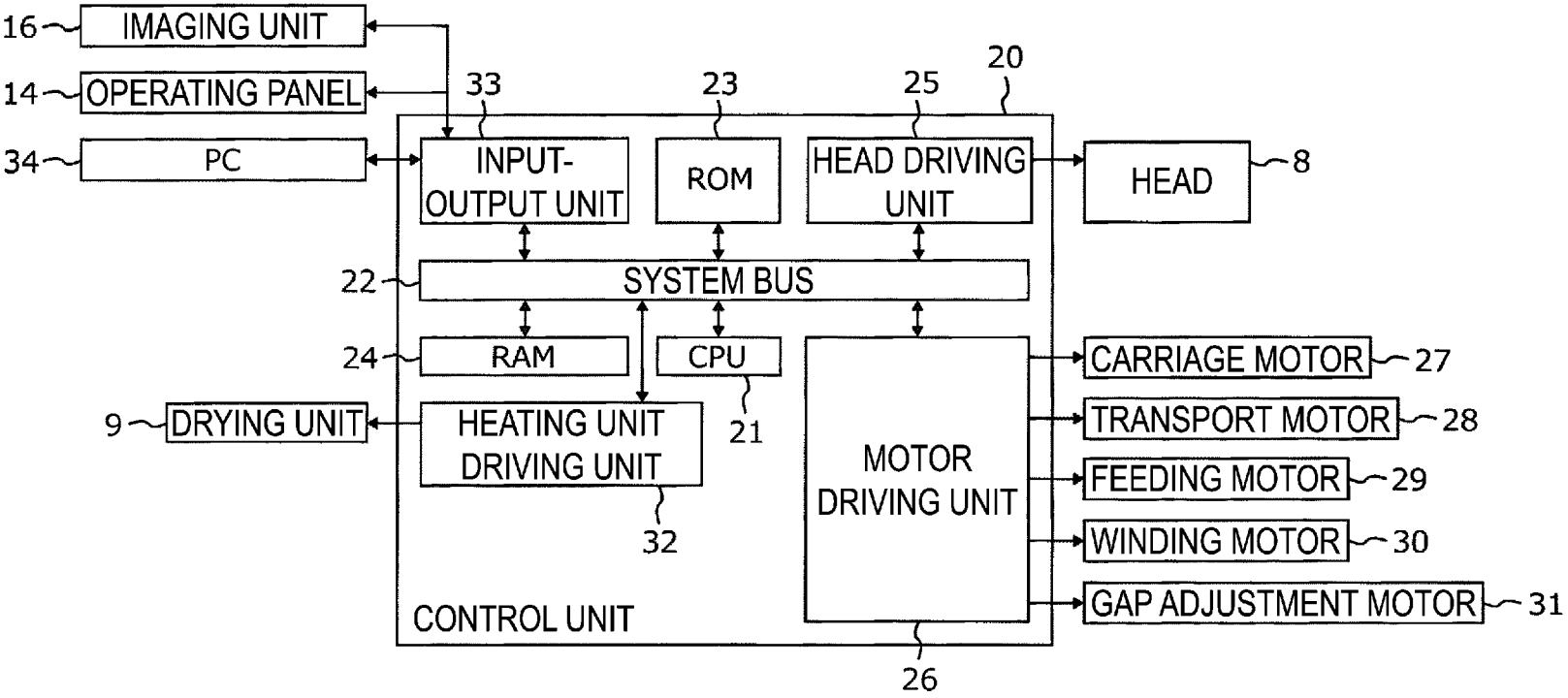
FIG. 4 is a block diagram illustrating an electrical configuration of the liquid ejecting device according to Example 1 of the present disclosure.

As illustrated in FIG. 4, the liquid ejecting device 1A of the present example is provided with a control unit 20. The control unit 20 is provided with a CPU 21 that performs control of the entire liquid ejecting device 1. The CPU 21 is connected, via a system bus 22, to a ROM 23 that stores various types of control programs and the like to be executed by the CPU 21, and a RAM 24 that can temporarily store data. Here, a first printing mode execution program, which is used to form the image on the medium M by applying ink to the medium M without applying the inhibitor to the medium M, and a second printing mode execution program, which is used to form the image on the medium M by applying the inhibitor to the medium M and applying the ink to the medium M applied with the inhibitor, are stored in the ROM 23.

Further, the CPU 21 is connected, via the system bus 22, to a head driving unit 25 that drives the recording head 8, that is, that causes the ink to be ejected.

Further, the CPU 21 is connected, via the system bus 22, to a motor driving unit 26 that is connected to a carriage motor 27, a transport motor 28, a feeding motor 29, a winding motor 30, and a gap adjustment motor 31.

Here, the carriage motor 27 is a motor that causes the carriage 7, on which the head 8 is mounted, to reciprocate in the width direction B. In addition, the transport motor 28 is a motor that drives the driving roller 4. Further, the feeding motor 29 is a rotating mechanism of the setting unit 2, and is a motor that drives the setting unit 2 in order to feed the medium M onto the transporting belt 5. Further, the winding motor 30 is a rotating mechanism of the winding unit 12, and is a motor that drives the winding unit 12 in order to take up the medium M into the roll shape. Then, the gap adjustment motor 31 is a drive motor of the gap changing unit 13 capable of adjusting the gap between the head 8 and the support surface F by moving the carriage 7 in the vertical direction.

Additionally, the CPU 21 is connected, via the system bus 22, to a drying unit driving unit 32 that drives the drying unit 9.

Furthermore, the CPU 21 is connected, via the system bus 22, to an input-output unit 33 that is connected to the imaging unit 16, an operating panel 14 of the liquid ejecting device 1, and a PC 34 that is used to perform reception and transmission of data, such as image data and the like, and signals.

Figure 5:
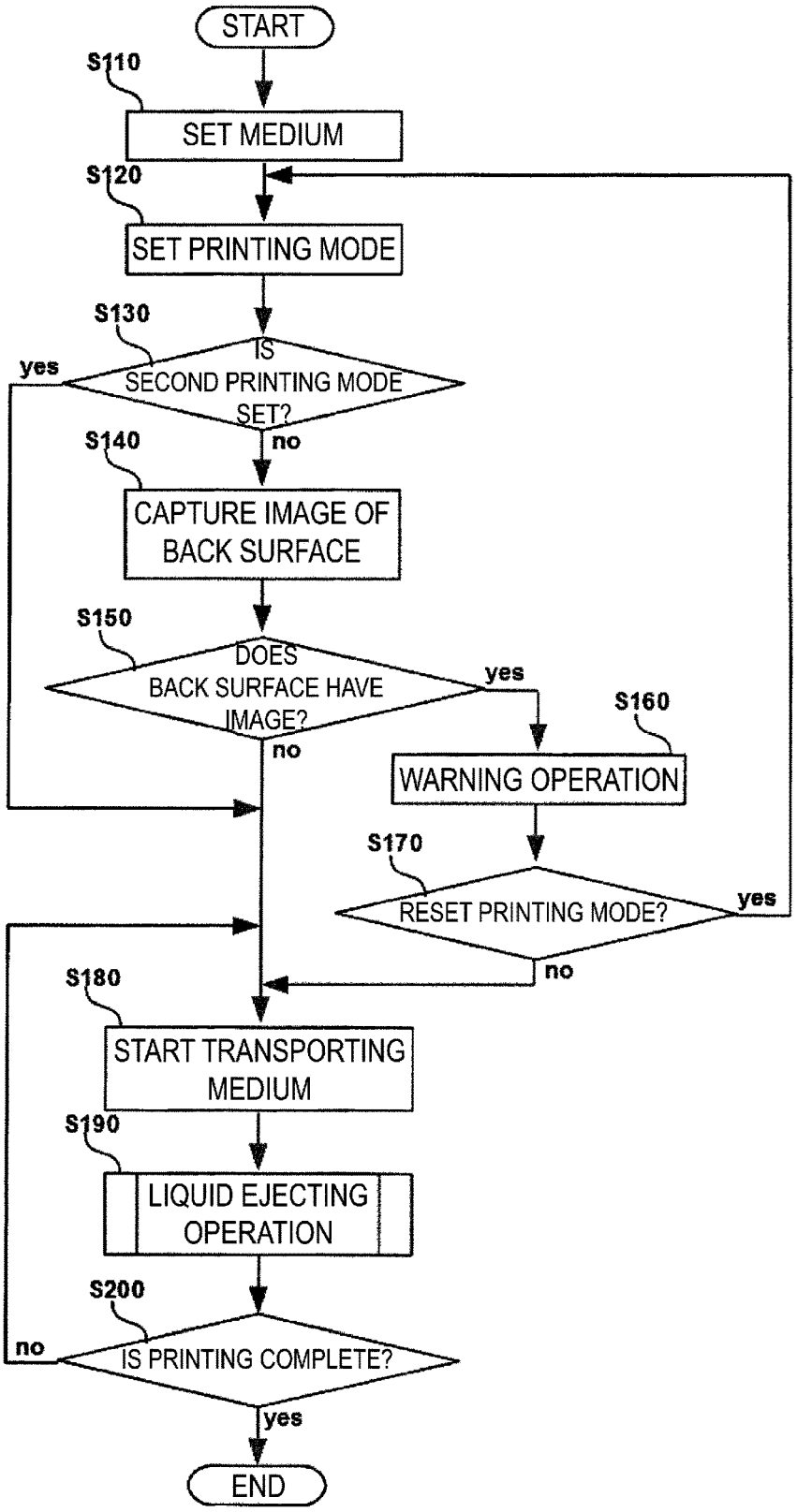
FIG. 5 is a flowchart of a liquid ejecting method that is executed using the liquid ejecting device according to Example 1 of the present disclosure.

Next, an example of a liquid ejecting method performed using the liquid ejecting device 1A of the present example will be described using a flowchart in FIG. 5.

In the liquid ejecting method of the present example, first, at step S110, a user sets the medium M on the liquid ejecting device 1A by setting the medium M on the setting unit 2, and arranging the medium M on the liquid ejecting device 1A so that the image can be formed on the medium M.

Next, at step S120, the user sets the printing mode using the operating panel 14, the PC 34, or the like. Specifically, the user selects whether to execute the first printing mode or the second printing mode. Note that, when the second printing mode is selected to be executed, it is also selected whether to perform a single-sided printing mode in which printing is performed on the first surface Ma only of the medium M, or a double-sided printing mode in which printing is performed on both the first surface Ma and the second surface Mb.

Then, at step S130, the control unit 20 determines whether the first printing mode is selected or the second printing mode is selected. When it is determined that the first printing mode is selected, the processing advances to step S140, and when it is determined that the second printing mode is selected, the processing advances to step S180.

At step S140, the imaging unit 16 captures an image of the second surface Mb of the medium M, that is, a back surface that is on the opposite side from a top surface when the first surface Ma on which the image is formed by the head 8A is the top surface.

Then, at step S150, the control unit 20 determines, from imaging data of the image capturing unit 16, whether or not an image is formed on the second surface Mb. When it is determined that the image is formed on the second surface Mb, the processing advances to step S160, and when it is determined that no image is formed on the second surface Mb, the processing advances to step S180.

At step S160, a warning operation is performed to alert the user that strike-through of the ink may occur. Specifically, for example, it is displayed on the operating panel 14 that the first printing mode is selected. This is because, since, in the first printing mode, the image is formed on the medium M by applying the ink to the medium M without applying the inhibitor to the medium M, depending on the type of the medium M used or the like, there is a risk that there may be strike-through of the ink, and if there is the strike-through of the ink, there is a risk that the quality of the image formed on the second surface Mb may deteriorate. Note that in the present example, an example is described in which a desired display is made on the operating panel 14 as the warning operation, but other warning operations may be performed, such as issuing a warning sound or warning message using voice or the like.

After performing the warning operation at step S160, the processing advances to step S170, where the user is prompted to choose whether or not to reset the printing mode. When the user chooses to reset the printing mode, the processing returns to step S120 and causes the printing mode to be reset, and when the user chooses not to reset the printing mode, the processing advances to step S180.

At step S180, the transport of the medium M is started as a result of control by the control unit 20, and the processing advances to step S190.

At step S190, a liquid ejecting operation is performed. Specifically, as a result of control by the control unit 20, by repeating the transport of the medium M using the transport device 6A and the transport device 6B, and the ejecting of the ink, or the ink and the inhibitor, from the head 8A and the head 8B while causing the carriage 7A and the carriage 7B to reciprocate, the image is formed on the medium M. Here, when the first printing mode is selected, only the ink is ejected from the head 8A and the head 8B, and when the second printing mode is selected, the ink and the inhibitor are ejected from the head 8A and the head 8B. Note that, by control of the control unit 20, an amount of ink applied per unit area when the second printing mode is selected is adjusted to be less than an amount of ink applied per unit area when the first printing mode is selected. Here, "the amount of ink applied per unit area when the second printing mode is selected is less than the amount of ink applied per unit area when the first printing mode is selected" means that the amount of ink applied per unit area in the second printing mode is less than the amount of ink applied per unit area in the first printing mode when forming the same image. The smaller the amount of ink applied per unit area, the less likely the strike-through of the ink in the medium M. Thus, in the second printing mode, the strike-through of the ink in the medium M is suppressed by reducing the amount of ink applied per unit area.

Note that at step S190, when the double-sided printing mode is selected at step S120, the first surface Ma is printed by the first printing unit 17, and the second surface Mb is printed by the second printing unit 18. On the other hand, when the single-sided printing mode is selected at step S120, the first surface Ma is printed by the first printing unit 17, and only the transport and taking up of the medium M is performed at the second printing unit 18 without the printing being performed thereby.

It is then determined at step S200 whether all of the printing of the image is complete, and, when it is determined that the printing is complete, the liquid ejecting method of the present example is ended. When it is determined that the printing is not complete, the processing returns to step S180 and repeats the processing from step S180 to step S200.

As described above, the liquid ejecting method of the present example is a liquid ejecting method for a liquid ejecting device 1 that is provided with the head 8 configured to be capable of ejecting liquid, that is, being capable of ejecting, as the liquid, the ink that contains the color material and forms the image on the medium M, and the inhibitor that inhibits the penetration of the color material into the medium M. Further, it is possible to select between the first printing mode in which the image is formed on the medium M by applying the ink to the medium M without applying the inhibitor to the medium M, and the second printing mode in which the image is formed on the medium M by applying the inhibitor to the medium M and applying the ink to the medium M applied with the inhibitor. At this time, the amount of ink applied per unit area in the second printing mode is less than the amount of ink applied per unit area in the first printing mode.

With respect to the above description from the point of view of a liquid ejecting device, the liquid ejecting device 1A of the present example is provided with the head 8 capable of ejecting the liquid, and the control unit 20 controls the application of the liquid onto the medium M by causing the liquid to be ejected from the head 8. Here, as the liquid, the head 8 is configured to be capable of ejecting the ink that contains the color material and forms the image on the medium M, and the inhibitor that inhibits the penetration of the color material into the medium M. Further, the control unit 20 is configured to select the first printing mode in which the control unit 20 forms the image on the medium M by applying the ink to the medium M without applying the inhibitor to the medium M, and the second printing mode in which the control unit 20 forms the image on the medium M by applying the inhibitor to the medium M and applying the ink to the medium M applied with the inhibitor. Further, the control unit 20 can cause the amount of ink applied per unit area in the second printing mode to be less than the amount of ink applied per unit area in the first printing mode.

In this way, the liquid ejecting method of the present example, and the liquid ejecting device 1A of the present example cause the amount of ink applied per unit area in the second printing mode, in which the image is formed on the medium M by applying the ink to the medium M applied with the inhibitor, to be smaller than the amount of ink applied per unit area in the first printing mode, in which the image is formed on the medium M by applying the ink to the medium M without applying the inhibitor. Thus, the amount of ink applied per unit area in the second printing mode can be reduced, and by reducing the amount of ink applied, the strike-through of the ink in the medium M can be suppressed even when the medium M or ink that is susceptible to strike-through is used, for example.

Further, as described above, the liquid ejecting device 1A of the present example is provided with the imaging unit 16 that captures the image of the second surface Mb, that is, the back surface, which is the surface on the opposite side from the top surface, when the first surface Ma, that is, the surface of the medium M facing the head 8, is the top surface, and with the operating panel 14 as the warning unit capable of performing the warning operation as a result of control by the control unit 20. Then, by performing the processing at step S160, the control unit 20 determines whether the image is formed on the back surface, based on the imaging data captured by the image capturing unit 16. When it is determined that the image is formed on the back surface when the first printing mode is selected, the control unit 20 can cause the warning unit to perform the warning operation. Thus, when forming the image on the top surface of the medium M on which the image is formed on the back surface, the liquid ejecting device 1A of the present example can reduce a possibility of deterioration of the quality of the image formed on the back surface by the strike-through of the ink ejected onto the top surface as a result of mistakenly selecting the first printing mode.

Further, as described above, the liquid ejecting device 1A of the present example is provided with the support surface F that supports the medium M at the position facing the head 8, and with the gap changing unit 13 that changes the gap between the head 8 and the support surface F. Then, the control unit 20 is capable of changing the amount of inhibitor applied per unit area in the second printing mode, on the basis of the gap. In general, the thin medium M is susceptible to the strike-through, and the thick medium M is not so susceptible to the strike-through, but the liquid ejecting device 1A of the present example changes the amount of inhibitor applied per unit area in the second printing mode, on the basis of the gap between the head 8 and the support surface F that corresponds to the thickness of the medium M, and thus, the strike-through of the ink can be suppressed in accordance with the thickness of the medium M. For example, preferably, the amount of inhibitor applied per unit area is reduced as the gap between the head 8 and the support surface F increases, and the amount of inhibitor applied per unit area is increased as the gap between the head 8 and the support surface F narrows. The reason for this is that, when the gap between the head 8 and the support face F is large, this means that the medium M being used is thick, and it can be assumed that the strike-through of the ink does not easily occur. Thus, the amount of inhibitor applied per unit area may be reduced. On the other hand, when the gap between the head 8 and the support surface F is narrow, this means that the medium M being used is thin, and it can be assumed that the strike-through of the ink occurs easily. Thus, the amount of inhibitor applied per unit area is preferably increased.

In the liquid ejecting device 1A of the present example, as the second printing mode, the control unit 20 can perform the single-sided printing mode in which the control unit 20 controls the head 8A, applies the inhibitor to the first surface Ma of the medium M, forms the image on the first surface Ma by applying the ink to the first surface Ma applied with the inhibitor, and ends the printing. Further, in the liquid ejecting device 1A of the present example, as the second printing mode, the control unit 20 can perform the double-sided printing mode in which the control unit 20 controls the head 8A, applies the inhibitor to the first surface Ma, forms the image on the first surface Ma by applying the ink to the first surface Ma applied with the inhibitor, and subsequently controls the head 8B, applies the inhibitor to the second surface Mb that is on an opposite side of the medium M from the first surface Ma, and forms the image on the second surface by applying the ink to the second surface applied with the inhibitor. In other words, the liquid ejecting device 1A of the present example is able to selectively execute the single-sided printing mode and the double-sided printing mode. Thus, through the single-sided printing mode, the liquid ejecting device 1A is able, while making the most of a basic condition of one surface of the medium M, to form the image on the other surface, and through the double-sided printing mode, is able to suppress the strike-through of the ink and form the images on both surfaces of the medium M. Here, the "basic condition" of the medium M refers to a state of the surface at a time at which the medium M is set on the setting unit 2. A specific pattern of the "basic condition" can be assumed to be a blank state, or a state in which a design has been applied by a method other than the liquid ejecting device 1A. The design applied by a method other than the liquid ejecting device 1A can be assumed to be, for example, a pattern formed by weaving, a pattern formed by writing by hand, a pattern formed by screen printing, a pattern formed by another printer, and the like. Note that when the single-sided printing mode is selected, in the printing unit 18, the carriage 7B and the head 8B are not driven, and only the transport device 6B and the winding unit 12 are driven.

In other words, as the head 8, the liquid ejecting device 1A of the present example includes the head 8A as a first ejecting unit capable of ejecting the liquid onto the first surface Ma, and the head 8B as a second ejecting unit capable of ejecting the liquid onto the second surface Mb. Then, in the double-sided printing mode, the control unit 20 can perform control to form the image on the first surface Ma by ejecting the liquid from the head 8A, and subsequently form the image on the second surface Mb by ejecting the liquid from the head 8B. Thus, the liquid ejecting device 1A of the present example can form the images on both surfaces of the medium M while favorably suppressing the strike-through of the ink, using the two heads 8, that is, the head 8A and the head 8B.

In this way, the liquid ejecting device 1A of the present example includes the two heads, that is, the head 8A and the head 8B, as the head 8. However, a configuration may be adopted in which a single head is used as the head 8. Below, Example 2 is described of a configuration including the single head as the head 8.

Figure 6:
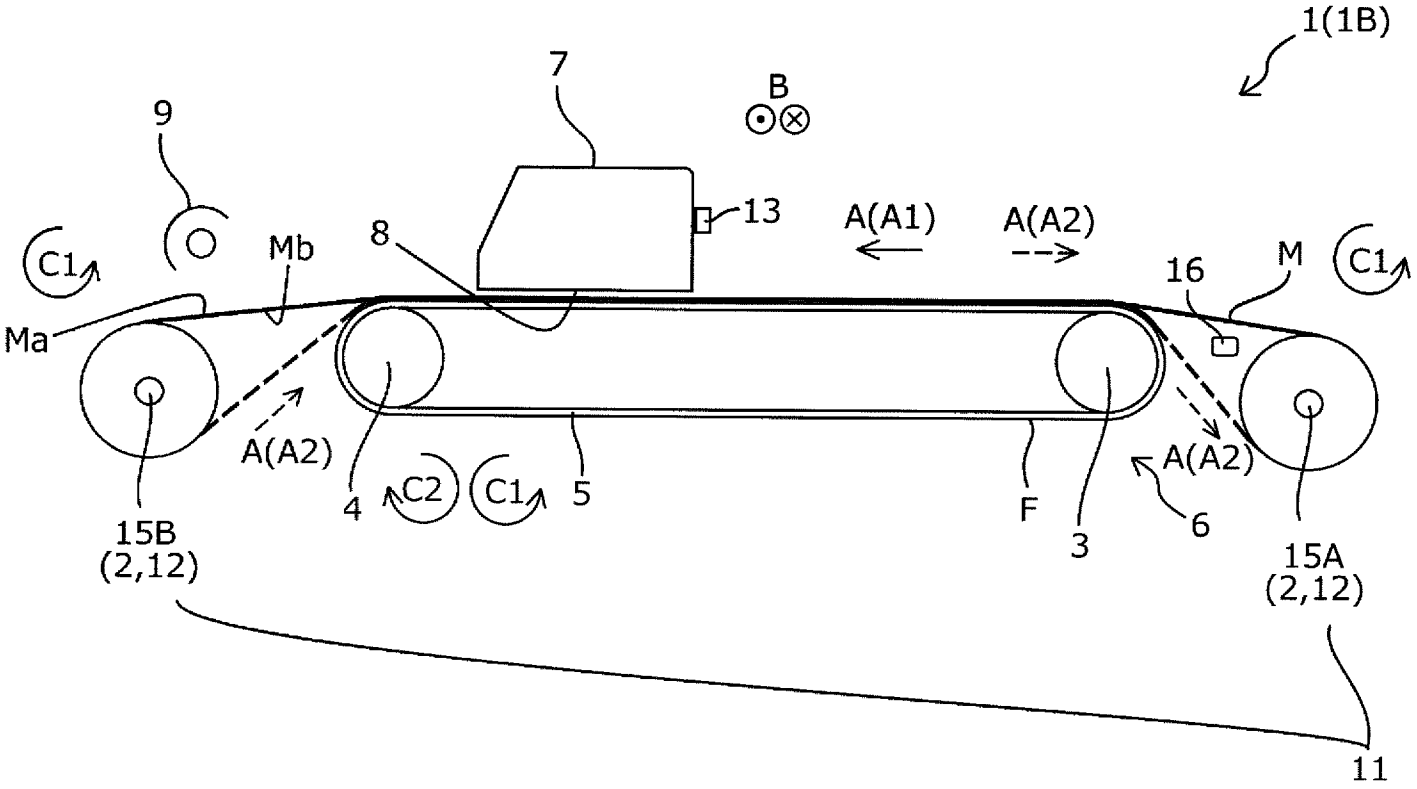
FIG. 6 is a schematic side view of a liquid ejecting device according to Example 2 of the present disclosure.

Example 2 (FIG. 6)

FIG. 6 is a schematic side view illustrating a liquid ejecting device 1B of the present example, and is a diagram corresponding to FIG. 1 illustrating the liquid ejecting device 1A of Example 1. Note that the same structural members as those in Example 1 described above are denoted by the same reference numerals, and a detailed description thereof will be omitted.

As illustrated in FIG. 6, the liquid ejecting device 1B of the present example is provided with rotating shafts 15A and 15B that are rotatable in the rotation direction C1 and that sandwich the transport device 6. The rotation shafts 15A and 15B also serve as the setting unit 2 and the winding unit 12, respectively. The liquid ejecting device 1B of the present example first rotates the rotating shaft 15A in the rotation direction C1, and feeds the medium M from the rotating shaft 15A to the transport device 6. Then, by driving the transport device 6 so that the driving roller 4 rotates in the rotation direction C1, the liquid ejecting device 1B transports the medium M in a direction A1 of the transport direction A, and uses the rotating shaft 15B to take up the medium M on which the image has been formed on the first surface Ma by ejecting the liquid from the head 8. Then, the liquid ejecting device 1B rotates the medium M taken up by the rotation shaft 15B in the rotation direction C1 so that the second surface Mb faces the head 8, and feeds the medium M from the rotating shaft 15B to the transport device 6. By driving the transport device 6 so that the driving roller 4 rotates in the rotation direction C2, the liquid ejecting device 1B transports the medium M in a direction A2 of the transport direction A, and uses the rotating shaft 15A to take up the medium M on which the image has been formed on the second surface Mb by ejecting the liquid from the head 8. According to such a configuration, the rotating shaft 15A and the rotating shaft 15B form an inversion mechanism 11 that allows the first surface Ma and the second surface Mb to be inverted and transported.

As described above, the liquid ejecting device 1 of the present example is provided with the inversion mechanism 11 for the medium M. Then, in the double-sided printing mode, after forming the image on the first surface Ma by ejecting the liquid from the head 8, the control unit 20 controls the inversion mechanism 11 and inverts the medium M, and can perform control to form the image on the second surface Mb by ejecting the liquid from the head 8. In other words, the liquid ejecting device 1 of the present example has a simple configuration provided with the single ejecting unit, and can also form the images on both surfaces of the medium M while suppressing the strike-through of the ink.

Note that the present disclosure is not limited to the above-described examples, and many variations are possible within the scope of the disclosure as described in the appended claims. It goes without saying that such variations also fall within the scope of the present disclosure.

What is claimed is:

1. A liquid ejecting device comprising:

an ejecting unit configured to eject liquid; and a control unit configured to perform control to cause the ejecting unit to eject the liquid to apply the liquid to a medium, wherein the ejecting unit is configured to eject, as the liquid, ink that contains a color material and is for forming an image on the medium, and inhibitor for inhibiting penetration of the color material into the medium, the control unit is configured to select a first printing mode for forming an image on the medium by applying the ink to the medium without applying the inhibitor to the medium, and a second printing mode for forming an image on the medium by applying the inhibitor to the medium and applying the ink to the medium applied with the inhibitor, and the control unit causes an amount of the ink applied per unit area in the second printing mode to be smaller than an amount of the ink applied per unit area in the first printing mode.

2. The liquid ejecting device according to claim 1, wherein the control unit is configured to select, as the second printing mode, a single-sided printing mode for forming an image on a first surface by applying the inhibitor to the first surface of the medium and applying the ink to the first surface applied with the inhibitor, and ending the printing, and a double-sided printing mode for forming an image on the first surface by applying the inhibitor to the first surface and applying the ink to the first surface applied with the inhibitor, and subsequently forming an image on a second surface by applying the inhibitor to the second surface on an opposite side of the medium from the first surface and applying the ink to the second surface applied with the inhibitor.

3. The liquid ejecting device according to claim 2, comprising:

as the ejecting unit, a first ejecting unit configured to eject the liquid onto the first surface, and a second ejecting unit configured to eject the liquid onto the second surface, wherein the control unit, in the double-sided printing mode, performs control to cause the first ejecting unit to eject the liquid to form an image on the first surface, and to subsequently cause the second ejecting unit to eject the liquid to form an image on the second surface.

4. The liquid ejecting device according to claim 2, comprising:

an inversion mechanism for the medium, wherein the control unit, in the double-sided printing mode, performs control to cause the ejecting unit to eject the liquid to form an image on the first surface, and to subsequently control the inversion mechanism to invert the medium, and cause the ejecting unit to eject the liquid to form an image on the second surface.

5. The liquid ejecting device according to claim 1, comprising:

an imaging unit configured to capture an image of a back surface, that is a surface on an opposite side of the medium from a top surface, when the top surface is a surface of the medium facing the ejecting unit, and a warning unit configured to perform a warning operation by control of the control unit, wherein the control unit determines, based on data of the image captured by the imaging unit, whether an image is formed on the back surface, and causes the warning unit to perform the warning operation in a case where it is determined that the image is formed on the back surface when the first printing mode is selected.

6. The liquid ejecting device according to claim 1, comprising:

a support surface configured to support the medium at a position facing the ejecting unit; and a gap changing unit configured to change a gap between the ejecting unit and the support surface, wherein the control unit changes, based on the gap, an amount of the inhibitor applied per unit area in the second printing mode.

7. The liquid ejecting device according to claim 1, wherein the inhibitor contains at least one of metal ions or saccharides.

* * * * *